US011174581B2

(12) United States Patent
Dirnberger et al.

(10) Patent No.: US 11,174,581 B2
(45) Date of Patent: Nov. 16, 2021

(54) OVERLIFTING DOOR LATCH WITH LOCKING MECHANISM

(71) Applicant: emz-Hanauer GmbH & Co. KGaA, Nabburg (DE)

(72) Inventors: Albert Dirnberger, Neunburg vorm Wald (DE); Dominik Walz, Nabburg (DE)

(73) Assignee: EMZ-HANAUER GMBH & CO. KGAA, Nabburg (DE)

( * ) Notice: Subject to any disclaimer, the term of this patent is extended or adjusted under 35 U.S.C. 154(b) by 637 days.

(21) Appl. No.: 16/033,301

(22) Filed: Jul. 12, 2018

(65) Prior Publication Data

US 2019/0017216 A1 Jan. 17, 2019

(30) Foreign Application Priority Data

Jul. 13, 2017 (DE) ..... 10 2017 006 642.6

(51) Int. Cl.
*D06F 37/42* (2006.01)
*E05B 47/06* (2006.01)
(Continued)

(52) U.S. Cl.
CPC ..... *D06F 37/42* (2013.01); *E05B 47/0603* (2013.01); *E05B 47/0607* (2013.01);
(Continued)

(58) Field of Classification Search
CPC ..... Y10T 292/1082; Y10T 292/0083; D06F 39/14; D06F 37/42; E05B 47/0603;
(Continued)

(56) References Cited

U.S. PATENT DOCUMENTS 6,390,518 B1 * 5/2002 Elick ..... A47L 15/4259 292/117
8,459,705 B2 * 6/2013 Suh ..... E05C 5/02 292/201
(Continued)

FOREIGN PATENT DOCUMENTS

CN 102677983 A 9/2012
CN 104894811 A 9/2015
(Continued)

OTHER PUBLICATIONS

German search report in counterpart application DE 10 2017 006 642.6, dated Apr. 6, 2018.

*Primary Examiner* — Kristina R Fulton
*Assistant Examiner* — Steven A Tullia
(74) *Attorney, Agent, or Firm* — Hayes Soloway PC

(57) ABSTRACT

A door latch for an electrical domestic appliance includes a rotary member rotationally movable in a rotation plane between a closing rotational position and a release rotational position, a movably arranged catch for arresting engagement by an overlifting rotational movement of the rotary member with the rotary member in its closing rotational position, and a locking assembly having a locking member movable between an unlocking position and a locking position. The rotary member is spring-biased towards the release rotational position and which, in the closing rotational position, holds a closure member to keep a door closed and, in the release rotational position, releases the closure member in order for the door to open. The locking member forms a first blocking arrangement by means of which the locking member in its locking position blocks the rotary member against rotation out of the closing rotational position into the release rotational position.

16 Claims, 5 Drawing Sheets

(51) Int. Cl.

| | |
|---|---|
| ***E05C 19/02*** | (2006.01) |
| ***E05C 3/24*** | (2006.01) |
| ***E05B 63/00*** | (2006.01) |
| ***D06F 39/14*** | (2006.01) |
| ***E05B 47/00*** | (2006.01) |

(52) U.S. Cl.
CPC ..... *E05B 63/0056* (2013.01); *E05C 3/24* (2013.01); *E05C 19/022* (2013.01); *D06F 39/14* (2013.01); *E05B 2047/0008* (2013.01); *E05B 2047/0081* (2013.01)

(58) Field of Classification Search
CPC ..... E05B 47/0607; E05B 63/0056; E05B 2047/0008; E05B 2047/0081; E05B 63/22; E05C 3/24; E05C 19/022; E05C 19/02; E05C 19/024; Y10S 292/04; Y10S 292/69
See application file for complete search history.

(56) References Cited

U.S. PATENT DOCUMENTS

| | | | | |
|---|---|---|---|---|
| 9,273,425 | B2 * | 3/2016 | Kim | D06F 39/14 |
| 2002/0101313 | A1 * | 8/2002 | Dirnberger | D06F 37/42 335/220 |
| 2003/0197387 | A1 * | 10/2003 | Dirnberger | E05B 17/22 292/216 |
| 2007/0108777 | A1 * | 5/2007 | Mueller | D06F 37/42 292/251.5 |
| 2011/0057460 | A1 * | 3/2011 | Onofrio | E05C 1/08 292/251.5 |
| 2012/0119522 | A1 * | 5/2012 | Bauriedl | E05B 17/0025 292/228 |
| 2013/0127181 | A1 * | 5/2013 | Rocchitelli | E05C 19/024 292/182 |
| 2016/0138809 | A1 * | 5/2016 | Colucci | E05C 19/00 292/122 |

FOREIGN PATENT DOCUMENTS

| | | | | |
|---|---|---|---|---|
| CN | 106048982 | A | 10/2016 | |
| CN | 106868788 | A | 6/2017 | |
| DE | 3919458 | A1 * | 12/1990 | E05C 3/24 |
| DE | 3919458 | A1 | 12/1990 | |
| DE | 19601230 | A1 | 7/1997 | |
| DE | 10230655 | A1 | 1/2004 | |
| DE | 102007009539 | B3 * | 7/2008 | E05C 3/24 |
| DE | 102007033451 | A1 * | 1/2009 | E05C 19/022 |
| DE | 102007033451 | B4 | 9/2011 | |
| DE | 202012005738 | U1 * | 11/2013 | E05C 3/12 |
| DE | 202015100627 | U1 | 6/2015 | |
| DE | 102015002538 | B3 * | 3/2016 | E05C 3/12 |
| DE | 102015002538 | B3 | 3/2016 | |
| EP | 878576 | A1 * | 11/1998 | E05C 3/24 |
| EP | 1460163 | B1 | 1/2009 | |
| EP | 2159358 | A2 * | 3/2010 | E05C 19/02 |
| KR | 200416692 | Y1 * | 5/2006 | E05C 3/24 |
| KR | 888167 | B1 * | 3/2009 | E05C 19/022 |
| KR | 20110044034 | A * | 4/2011 | A47L 15/4259 |
| KR | 101667916 | B1 * | 10/2016 | E05B 47/0603 |
| WO | WO-2010056062 | A2 * | 5/2010 | E05C 19/022 |
| WO | WO-2012123980 | A1 * | 9/2012 | E05C 3/16 |
| WO | WO-2016126675 | A1 * | 8/2016 | E05B 47/0603 |

* cited by examiner 10
48
22
44
28
38
52
49
46
90
86
82
24
88
20
30
16
14
26
50
94
92
96
12

OVERLIFTING DOOR LATCH WITH LOCKING MECHANISM

BACKGROUND OF THE INVENTION

1. Field of the Invention

The present invention relates generally to a door latch for an electrical domestic appliance. Particularly, the present invention relates to a door latch for a laundry treatment appliance.

2. Description of the Prior Art

The door latches considered within the context of the present disclosure comprise a rotary member which is arranged to be rotationally movable in a rotation plane between a closing rotational position and a release rotational position and is spring-biased in the direction towards the release rotational position and which, in the closing rotational position, holds a closure member in order to keep a door of the domestic appliance closed and, in the release rotational position, releases the closure member in order for the door to open. The door latches of the type under consideration here further comprise a movably arranged catch for arresting engagement, which is releasable by an overlifting rotational movement of the rotary member, with the rotary member in its closing rotational position.

A conventional door latch of the type discussed above is described, for example, in DE 39 19 458 A1. According to that document, the conventional door latch described therein is intended in particular for use in a tumble dryer. Although a secure closing function of the door latch is routinely desired in the case of tumble dryers, the latch is generally not required additionally to be able to lock the closed door during operation of the tumble dryer. On the contrary, the requirement profile in the case of tumble dryers is often that the door can also be opened by a user during the drying operation, for example in order to introduce further wet laundry or in order to be able to check the degree of dryness of the laundry in the dryer.

With regard to the prior art relating to overlifting door latches, reference is further made to DE 10 2007 033 451 B4, DE 196 01 230 A1 and EP 1 460 163 B1.

In contrast to tumble dryers, it is routinely required in the case of washing machines for domestic use that the closed door is capable of being locked during washing operation of the washing machine. The user is to be protected from contact with the washing water, which is usually at a temperature of up to 90 degrees or 95 degrees Celsius; washing water is also to be prevented from escaping from the washing vessel of the machine. Therefore, a user should not usually be able to open the washing machine door during the washing operation.

SUMMARY OF THE INVENTION

It is an object of the invention to equip an overlifting door latch with a suitable locking mechanism so that it is suitable for use in a washing machine. The door latch is to have as simple a construction as possible while having high operational reliability.

In order to achieve that object, a door latch of the type referred to above further comprises, according to the invention and in conformity with independent claim 1, a locking assembly having a locking member, which is arranged to be movable between an unlocking position and a locking position, for blocking at least one movable component of the door latch when the door is closed. In its locking position, the locking member blocks the rotary member against rotation out of the closing rotational position into the release rotational position, and in the unlocking position it permits such a rotation of the rotary member. The locking member thus cooperates directly with the rotary member in order to effect locking of the door latch when the door is closed. It is suitably configured to prevent, in the locked state, rotation of the rotary member into the release rotational position, even if the arresting of the rotary member by the catch is released for any reason (e.g. as a result of vibrations or by pushing against the door from the outside). The door latch can accordingly continue to remain locked even if the rotary member, intentionally or unintentionally, is no longer being held by the catch. This is expedient in the case of washing machines in particular, where the door is not to come open during the washing operation. If the arresting of the rotary member by the catch is released for any reason during the washing operation, the blocking of the rotary member by the locking member ensures that the rotary member cannot rotate into its release rotational position and the door therefore remains closed.

In some embodiments, the locking member forms a first blocking arrangement which, in the locking position of the locking member, can be clamped between the rotary member and an abutment structure, in a clamping rotational position of the rotary member between the closing rotational position and the release rotational position. The clamping of the first blocking arrangement is releasable by a rotational movement of the rotary member out of the clamping rotational position in the direction towards the closing rotational position. If in these embodiments the arresting engagement of the catch with the rotary member is released for any reason when the door latch is in the locked state, the rotary member rotates out of the closing rotational position slightly further in the direction towards the release rotational position under the action of its spring bias. However, because the locking member is in its locking position, the rotary member cannot rotate as far as the release rotational position. Instead, the rotation of the rotary member is stopped by the first blocking arrangement, in the clamping rotational position. The first blocking arrangement is thereby clamped between the rotary member and the abutment structure, which can be formed, for example, on a latch housing of the door latch.

The clamping rotational position can be comparatively near and in any case much nearer in the closing rotational position than in the release rotational position. Accordingly, in some embodiments, the rotation angle between the clamping rotational position and the closing rotational position of the rotary member is smaller, in particular smaller by a multiple, than the rotation angle between the clamping rotational position and the release rotational position of the rotary member. For example, the rotation angle between the clamping rotational position and the closing rotational position of the rotary member is not more than 15 degrees or not more than 10 degrees or not more than 5 degrees. By contrast, the rotation angle between the closing rotational position and the release rotational position of the rotary member is, for example, not less than 30 degrees or not less than 40 degrees or not less than 45 degrees or not less than 50 degrees.

Advantageously, the clamping rotational position is situated at such a position within the rotation angle range between the release rotational position and the closing rotational position of the rotary member that the closure member is held by the rotary member in order to keep the door closed also in the clamping rotational position. The closure member is consequently caught in the rotary member even in the clamping rotational position.

In some embodiments, the locking member is subjected or can be subjected in the locking position to the action of a spring bias, which biases the locking member in the direction towards its unlocking position. This spring bias provides the precondition for the automatic return of the locking member into the unlocking position as soon as the locking member in the clamping rotational position of the rotary member is released and the locking member is thereby able to escape from clamping between the rotary member and the abutment structure. Such a release is possible by rotating the rotary member out of the clamping rotational position slightly further in the direction towards the closing rotational position. This rotation can be effected by the user pushing against the door of the domestic appliance.

In some embodiments, the locking assembly is so configured that activation of the locking assembly with the purpose of unlocking the door latch is possible while the rotary member is in its clamping rotational position and the first blocking arrangement is clamped. Although this unlocking activation of the locking assembly does not lead directly to a return of the locking member into its unlocking position, because the clamping of the first blocking arrangement stands in the way of such a return of the locking member, the unlocking activation of the locking assembly brings about a state in which, after the first blocking arrangement has been released, the locking member is able to spring back into its unlocking position solely under the action of the spring bias, without re-activation of the locking assembly.

For this purpose, the locking assembly can comprise a locking actuator having a positioning element whose position can be adjusted by activation of the locking actuator, wherein the locking member can be transferred against a restoring spring force out of the unlocking position into the locking position by means of a carrier coupling with the positioning element and, when uncoupled from the carrier element, can be returned. The carrier coupling can be a push- or pull-type coupling which is provided only for transferring the locking member out of the unlocking position into the locking position. There is no such coupling in the opposite movement direction of the positioning element so that, although the positioning element moves back in the case of an unlocking activation of the locking actuator, the locking member remains in its locking position if the first blocking arrangement is clamped between the rotary member and the abutment structure. As soon as the first blocking arrangement is released and comes free, the locking member moves back into its unlocking position under the action of the restoring spring force, that is to say is uncoupled from the positioning element—which has already moved back previously.

If the first blocking arrangement is not clamped in the locking position of the locking member (because the rotary member is arrested by the catch and is in its closing rotational position), the locking member is able to move back into its unlocking position synchronously with the positioning element in the case of an unlocking activation of the locking actuator. However, the locking member only follows the movement of the positioning element, without being pushed or pulled thereby.

The locking actuator can be an electromagnetic actuator, for example. An electromotive form of the locking actuator is also conceivable, for example with a step motor.

In other embodiments, the locking assembly can comprise a locking actuator having a positioning element which is in push- or pull-transmitting coupling with the locking member and is able, in the case of an unlocking activation of the locking actuator, to build up a spring bias which is able to effect a return of the positioning element and, associated therewith, a transfer of the locking member out of the locking position into the unlocking position. For example, the locking actuator in these embodiments can be in the form of a bimetallic actuator which has as the positioning element a bimetallic strip in which an internal stress develops on cooling (unlocking activation), if the bimetallic strip, due to clamping of the locking member, is unable to move out of the position it has previously assumed in the heated state. Instead of a bimetallic actuator, a configuration of the locking actuator with a positioning element made of a shape memory material is conceivable, for example.

In some embodiments, the abutment structure is formed on a housing component of a housing of the door latch which accommodates the rotary member, the catch and the locking assembly.

In some embodiments, the locking member is arranged to be movable transversely, in particular perpendicularly, to the rotation plane of the rotary member at least in an end portion of its movement path that includes the locking position. For example, the latch member is in the form of a linear slider which is arranged to be linearly movable in a sliding direction perpendicular to the rotation plane of the rotary member. Alternatively, the locking member can be formed by a pivotably arranged rotary slide.

In some embodiments, the locking member forms a second blocking arrangement which blocks the catch in at least one movement direction in the locking position of the locking member. The second blocking arrangement offers increased certainty that the catch will not be released from the arresting engagement with the rotary member in the locked state of the door latch. For example, the second blocking arrangement can prevent the arresting of the rotary member from being released by pushing against the door from outside (overlifting).

From DE 39 19 458 A1 mentioned at the beginning, it is known to provide an emergency opening mechanism which effects release of the arresting engagement between the catch and the rotary member by pressing against the door from the inside (that is to say from inside the laundry treatment chamber, closed by the door, of the domestic appliance) and thereby opens the door latch. As pressure is exerted from inside against the door, the catch meets a stop and is thereby lifted out of engagement with the rotary member.

In some embodiments of the door latch considered within the context of the present disclosure (these embodiments not being bound to the capability of the rotary member to be blocked by the locking member), the door latch comprises a carrier component for the rotary member, which carrier component is arranged to be displaceable, in particular pivotable, against spring force out of a rest position into an emergency opening position, wherein, upon displacement of the carrier component out of the rest position into the emergency opening position, the catch can be lifted out of arresting engagement with the rotary member by striking a stop arrangement. In contrast to the solution according to DE 39 19 458 A1, the stop arrangement is formed on the locking member and is moved in the locking position of the locking member out of a standby position, in which the stop arrangement is ready for striking by the catch. Because the stop arrangement is formed on the locking member and accordingly is arranged to be movable relative to the catch, a configuration can be achieved in which the stop arrangement is available for the emergency opening function only in the unlocked state of the door latch, whereas in the locked state of the door latch it is out of range of the catch, so that the emergency opening function is not available in the locked state.

In some embodiments, the door latch additionally comprises an opening assembly having an opening actuator, in particular an electromagnetic actuator, and an actuating element, movable by activation of the opening actuator, for acting on the catch in order to lift it out of arresting engagement with the rotary member. A suitable control signal for activation of the opening actuator can be generated, for example, by an operational control unit of the domestic appliance at the end of an operating run of the appliance or can be generated by a user by pushing a button located on the outside of the domestic appliance. The opening assembly offers a further possibility, in addition to the overlifting rotational movement of the rotary member, for opening the door latch.

The present disclosure also includes a laundry treatment appliance, in particular a washing machine, having a laundry treatment chamber which is formed in an appliance main body and can be closed by a door, wherein the laundry treatment appliance is equipped with a door latch of the type described above.

The invention will be explained further hereinbelow with reference to the accompanying drawings.

DETAILED DESCRIPTION OF THE INVENTION

Figure 1:
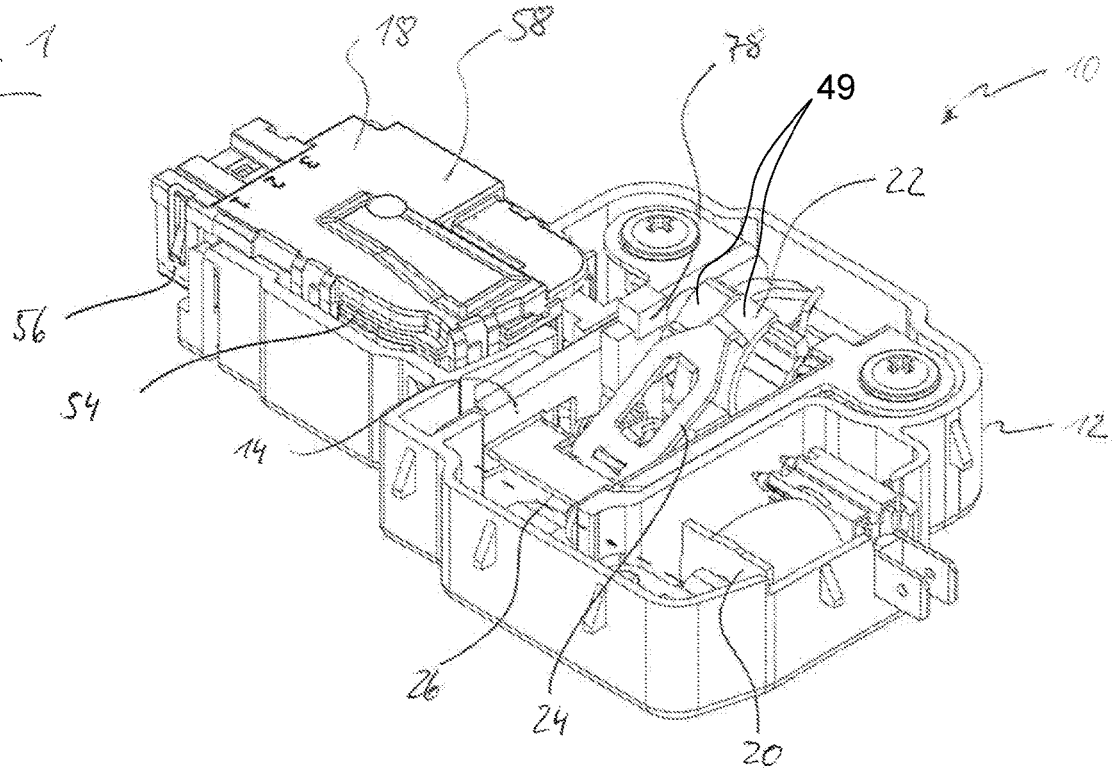
FIG. 1 is a perspective view of a door latch according to an embodiment in an open state.

The door latch generally designated 10 in the figures has a multi-part latch housing 12 in which a carrier lever 14, a locking slider 16 (see in particular FIG. 2), a locking module 18 and an opening unit 20 are accommodated as the main components. A rotary member 22 and a catch 24 which is pivotable in at least two movement directions are additionally mounted on the carrier lever 14. In the region of one of its lever ends, the carrier lever 14 is mounted on the latch housing 12 to be pivotable about a pivot axis 26. The rotary member 22 is mounted on the carrier lever 14 to be rotatable about a rotation axis 28 which is parallel to the pivot axis 26 and stationary relative to the carrier lever 14. By means of a pair of spring elements (here: helical compression springs) 30 (see FIGS. 4, 6 and 7) arranged axially on either side of the rotary member 22, the carrier lever 14 is biased into a rest position, from which it can be pivoted, for the purposes of emergency opening, about the pivot axis 26 against the force of the spring element 30 into an emergency opening position.

The door latch 10 is provided for fitting into a domestic washing machine, for example, whereby the latch housing 12 is to be fixed, for example, to a machine wall of a machine main body of the washing machine, in which a washing vessel (drum or barrel) is rotatably mounted. A closure member 32 (see FIG. 6) is attached to a door, which is pivotably mounted on the machine main body and serves to close an access opening to the washing vessel, which closure member enters an insertion opening 34 formed in the latch housing 12 when the door is closed and cooperates with the rotary member 22, which can be also be referred to as a gripper. It will be appreciated that a reverse assembly pattern can be chosen as an alternative, that is to say the closure member 32 can be mounted on the machine main body and the latch housing 12 with the components accommodated therein can be fixed to the door.

Figure 3:
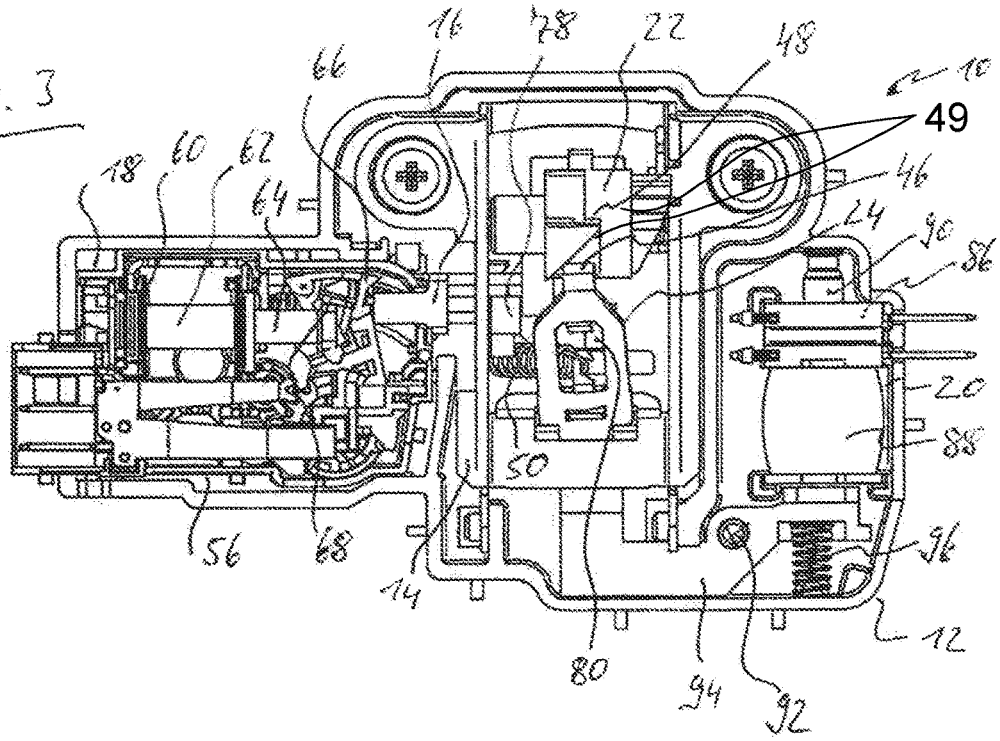
FIG. 3 is a top view of the door latch of FIG. 1, wherein a housing cover of the locking module has been removed.
Figure 4:
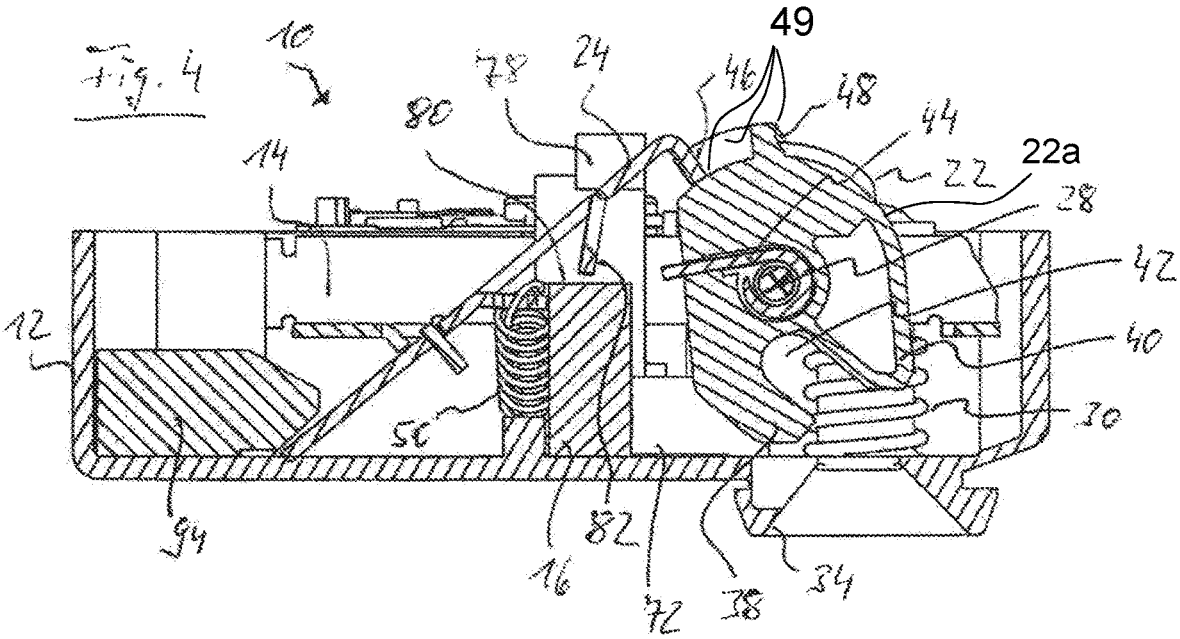
FIG. 4 is a sectional view of the door latch of FIG. 1 in the open state.
Figure 6:
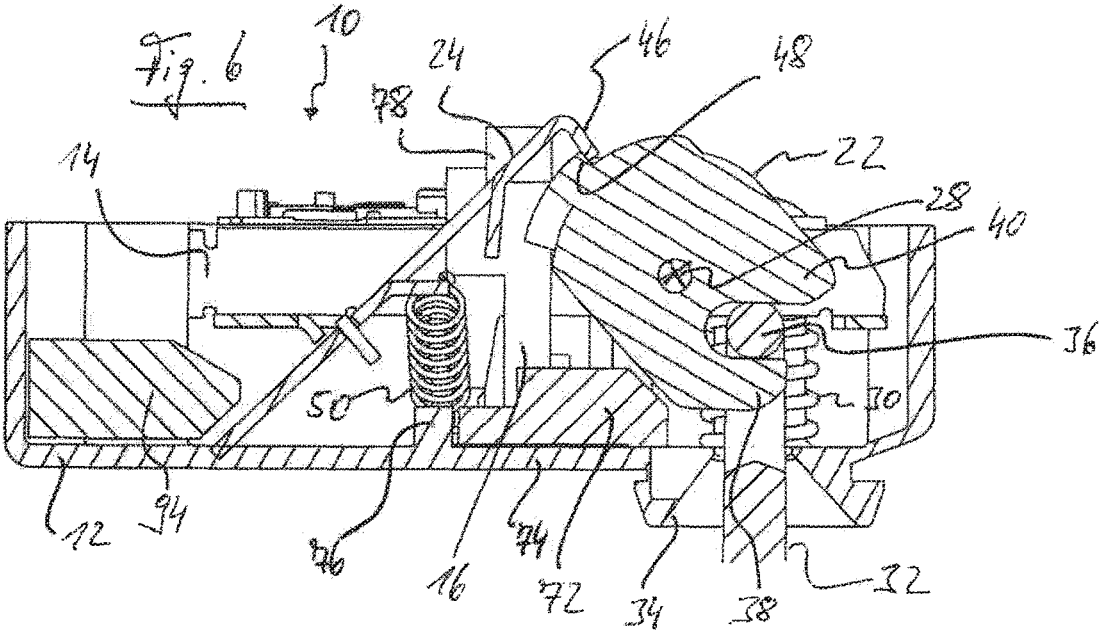
FIG. 6 is a sectional view of the door latch in the state according to FIG. 5.

When the door is open, the rotary member 22 assumes a release rotational position which can be seen in FIG. 4, in which it is ready for a transverse stirrup 36 of the closure member 32 to enter a gripping mouth 42, delimited by two jaws 38, 40, of the rotary member 22. As the door closes, the closure member 32 first comes into contact with its transverse stirrup 36 with the jaw 40 and thereby initiates a rotation of the rotary member 22 about the rotation axis 28 against the force of a biasing spring 44, which is formed in the example shown by a leg spring and which biases the rotary member 22 into the release rotational position. As the rotary member 22 rotates, the jaw 38 moves behind the transverse stirrup 36 of the closure member 32. During the rotary action of the rotary member 22, a nose 46 of the catch 24 slides along the sliding guide 49 of the rotary member 22 (shown in FIGS. 2-4) as the rotary member rotates from the release rotational position towards the closing rotational position whereby the nose 24 snaps behind the arresting edge 48 under the action of the biasing spring force of biasing spring 44 as soon as the rotary member 22 reaches the closing rotational position. As soon as the rotary member 22 reaches a closing rotational position shown in FIG. 6, the catch 24 engages by means of the nose 46 behind an arresting edge 48 formed on the outer periphery of the rotary member 22 and thus prevents the rotary member 22 from rotating back in the direction towards the release rotary position. The transverse stirrup 36 of the closure member 32 is in this state caught in the gripping jaw 42 of the rotary member 22; the door is closed. This situation is shown in FIG. 6 (the rotary member 22 additionally being shown locked in FIG. 6).

The arresting edge 48 is part of a sliding guide 49 which is formed on the outer periphery 22*a* of the rotary member 22 and which allows the door latch 10 to be opened by an overlift (renewed pushing against the door of the washing machine from outside). If, starting from the closed but unlocked state of the door latch 10, the user pushes against the door, this causes the rotary member 22 to rotate beyond the closing rotational position (overlifting rotational movement). The sliding guide 49 is in such a form that, in the case of such an overlifting rotational movement of the rotary member 22, the nose 46 of the catch 24 springs away from the arresting edge 48 sideways, under the action of a second biasing spring 50 acting on the catch 24. The second biasing spring 50 thereby urges the nose 46 of the catch 24 onto a portion of the sliding guide that does not offer any possibility of arresting the rotary member 22. If the user then removes the pressure from the door, the rotary member 22 therefore rotates under the action of a first biasing spring 44 back in the direction towards the release rotational position. Because the nose 46 of the catch 24 thereby no longer has an arresting hold on the rotary member 22, the rotary member 22 rotates beyond the closing rotational position into the release rotational position according to FIG. 4. For further details of the sliding guide formed on the outer periphery of the rotary member 22, reference is made by way of example to DE 39 19 458 A1, in particular to the explanations given therein in relation to FIGS. 3 to 5 of the mentioned document.

Figure 2:
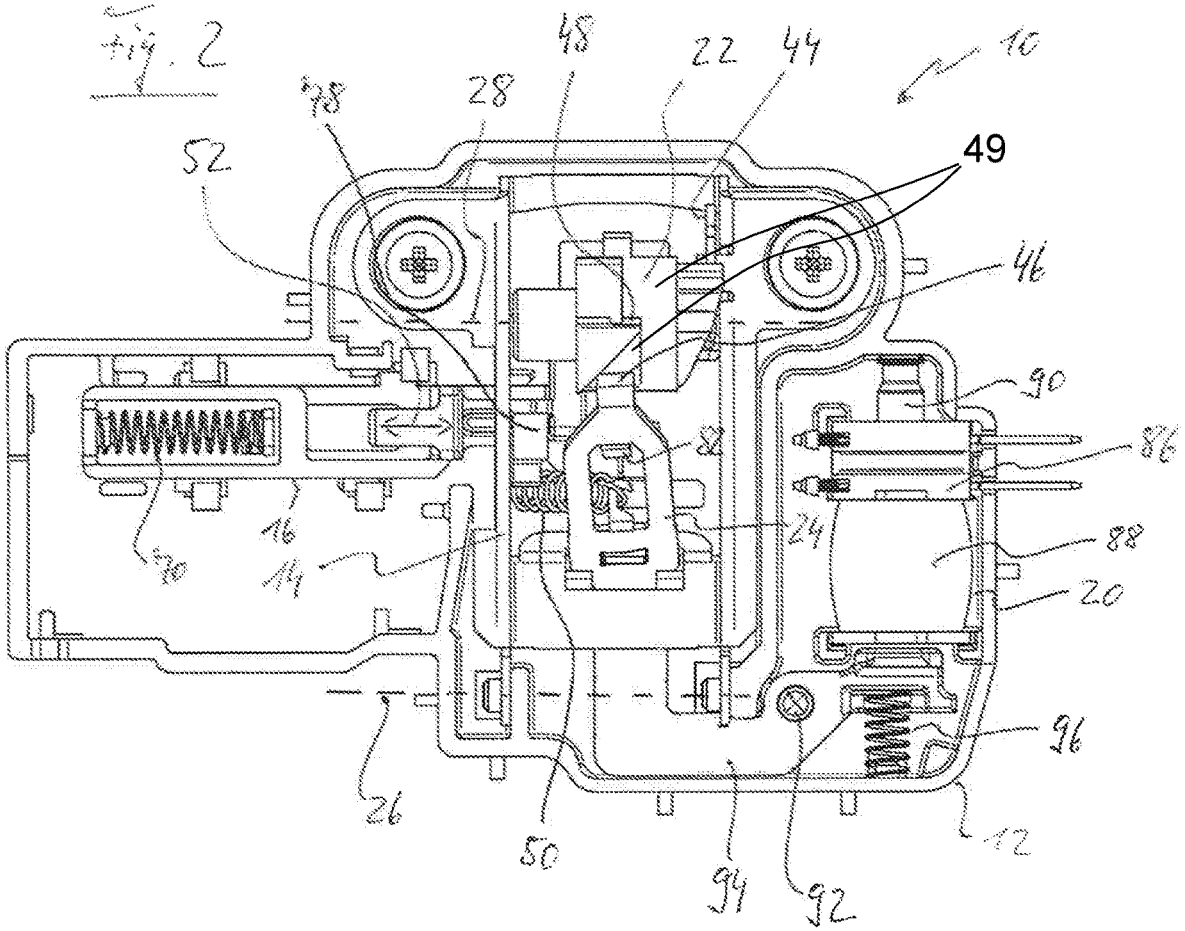
FIG. 2 is a top view of the door latch of FIG. 1, wherein a locking module of the latch has been removed.
Figure 5:
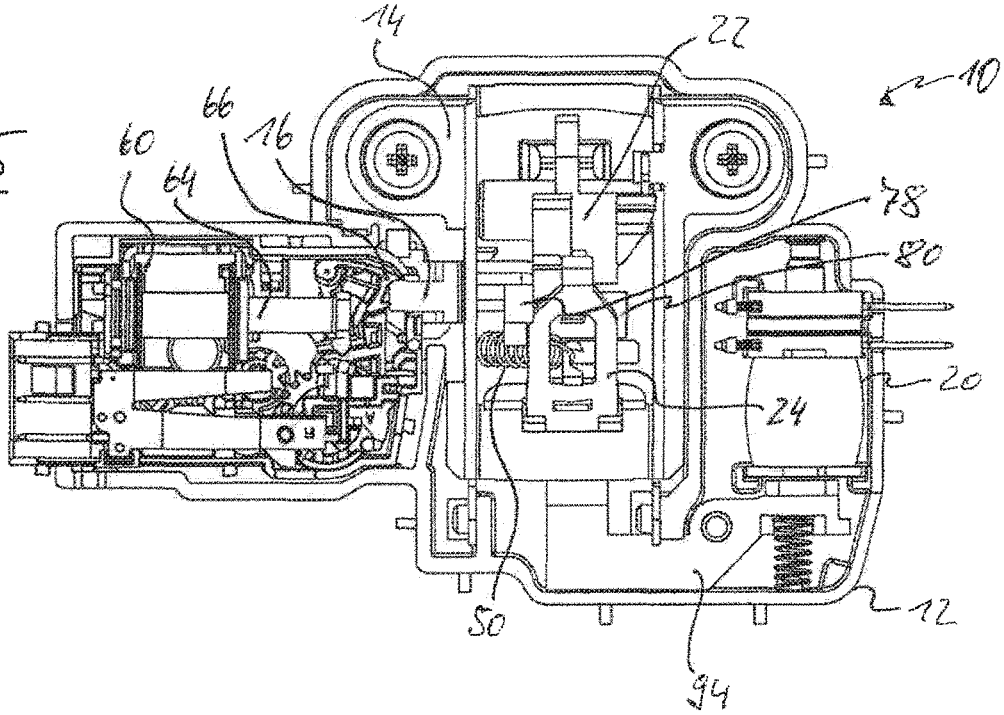
FIG. 5 is a top view of the door latch of FIG. 1 similar to FIG. 3 but in a closed and locked state.

The locking slider 16 forms a locking member within the meaning of the invention and is linearly displaceable in the embodiment shown in a sliding direction 52 parallel to the rotation axis 28 of the rotary member 22 (that is to say perpendicular to the rotation plane of the rotary member 22) (see FIG. 2). The locking module 18 serves to control the movement of the locking slider 16 and forms a structural unit which can be pre-assembled and inserted as such into the latch housing 12. The locking module 18 comprises a module housing 54 having a housing bottom part 56 and a housing cover 58, which has been removed in the views of FIGS. 3 and 5. The locking module contains an electromagnetic actuator 60 having a magnetic coil, of which only a coil body 62 is shown in FIGS. 3 and 5, and further having an armature plunger 64 which can be pulled into the magnetic coil by excitation thereof, and a positioning element 66 which is coupled with the armature plunger 64 for transmitting pull and push.

In the example shown, the positioning lever 66 is in the form of a pivotably mounted positioning lever which is pivotable by excitation of the magnetic coil and consequently by movement of the armature plunger 64. The positioning lever 66 is adjustable by successive pulse-like excitations of the magnetic coil alternately into two different pivot positions, which correspond to an unlocking position or locking position of the locking slider 16. In FIG. 3, the positioning lever 66 assumes one of these defined pivot positions, and in FIG. 5 it assumes the other pivot position. For the stable adjustment of the positioning lever 66 into the two pivot positions, there is provided in the example shown a sliding guide having a path follower which is formed by a wire stirrup 68 and revolves endlessly in a sliding guide path, which is not shown in greater detail in the figures. Such sliding guides are generally known; a more detailed explanation is not required at this point. Of course, the electromagnetic actuator 60 is not the only possibility for moving the positioning lever 66 or a positioning element generally between two stable positions corresponding to the unlocking position and the locking position of the locking slider 16. For example, an electromotive drive unit can be provided as an alternative.

In the embodiment shown, the locking slider 16 is provided only for transferring from the unlocking position into the locking position in a carrier coupling (here: push-type coupling) with the positioning lever 66. The return movement of the locking slider 16 out of the locking position into the unlocking position takes place only under the force of a third biasing spring 70 (see FIG. 2), which biases the locking slider 16 into its unlocking position. When the door latch 10 is locked, that is to say when the positioning lever 66 is transferred out of the pivot position according to FIG. 3 into the pivot position according to FIG. 5, the positioning lever 66 pushes the locking slider 16 against the force of the third biasing spring 70 out of the unlocking position into the locking position (on the right in the representation of FIG. 3). As a result, a spring bias which can be used for the return of the locking slider 16 builds up in the third biasing spring 70 or an already existing spring bias is increased. The third biasing spring 70 acts as a mechanical energy store, which is charged, as it were, when the latch 10 is locked. When the positioning lever 66 pivots out of the pivot position according to FIG. 5 into the pivot position according to FIG. 3, on the other hand, there is no longer a carrier coupling between the positioning lever 66 and the locking slider 16. In this movement direction there is neither a pushing- or a pulling-force-transmitting coupling between the positioning lever 66 and the locking slider 16. If the locking slider 16 is not blocked in the case of an unlocking actuation of the electromagnetic actuator 60, the locking slider 16 follows the movement of the positioning lever 66 on account of the spring tension of the third biasing spring 70 and moves back into its unlocking position. However, if the locking slider 16 is blocked in its locking position (see below), only the positioning lever 66 moves back, whereas the locking slider 16 remains in its locking position until its blocking is eliminated. The mechanical energy store formed by the third biasing spring 70 thus permits a return of the locking slider 16 from the locking position into the unlocking position that is decoupled from the positioning lever 66 in terms of time and mechanically.

In order to lock the door latch 10 in the closed state, the locking slider 16 is formed with a first blocking arrangement 72 (see in particular FIG. 6), which in the locking position of the locking slider 16 has moved into the rotation path of the rotary member 22 and thereby prevents the rotary member 22 from rotating back out of the closing rotational position according to FIG. 6 into the release rotational position according to FIG. 4. Specifically, the first blocking arrangement 72, when the locking slider 16 is transferred from the unlocking position into the locking position, moves into the rotation path of the jaw 38 of the rotary member 22, which in the closed state engages behind the transverse stirrup 36 of the closure member 32. In the unlocked state, on the other hand, the first blocking arrangement 72 has moved out of the rotation path of the jaw 38 and does not constitute an obstacle to the rotation of the rotary member 22 out of the closing rotational position back into the release rotational position.

It has been mentioned that, in the locked state of the door latch 10, blocking of the locking slider 16 can occur, which prevents the locking slider 16 from automatically returning from the locking position into the unlocking position. Such blocking of the locking slider 16 can occur when, in the locked state, the nose 46 of the catch 24 slips away from the arresting edge 48 of the rotary member 22, for example as a result of vibrations, and therefore the catch 24 loses the arresting engagement with the rotary member 22. After the loss of the arresting of the rotary member 22 by the catch 24, the rotary member 22 attempts to rotate, under the action of the first biasing spring 44, out of the closing rotational position in the direction towards the release rotational position. After a certain, comparatively small rotation angle of, for example, a few degrees, it meets the first blocking arrangement 72 (clamping rotational position of the rotary member 22). The force of the first biasing spring 44 then leads to clamping of the first blocking arrangement 72 between the rotary member 22 and an abutment structure formed by the latch housing 12, which abutment structure is formed in the example shown by a base plate 74 of the latch housing 12 and a supporting rib 76 formed on the base plate 74. Clamping of the first blocking arrangement 72 of the locking slider 16 occurs in any case after such a small rotation angle of the rotary member 22 that the closure member 32 remains caught in the gripping jaw 42 of the rotary member 22, that is to say the door remains closed. Even after an unlocking activation of the electromagnetic actuator 60 and pivoting of the positioning lever 66 back into the pivot position according to FIG. 3, the clamping of the locking slider 16 initially persists and the door remains closed. Only when the user then again pushes against the door and initiates an overlifting rotational movement of the rotary member 22 is the clamping of the locking slider 16 released, whereupon the third biasing spring 70 urges the locking slider 16 back into its unlocking position. If the user then releases the door, the rotary member 22 is free to rotate back into the release rotational position according to FIG. 4, because the first blocking arrangement 72 no longer blocks the rotary member 22 against rotation.

There is further formed on the locking slider 16 a second blocking arrangement 78, which serves to block the catch 24 against lateral pivoting in the case of an overlifting opening attempt. In the locked state, the second blocking arrangement 78 prevents lateral pivoting of the catch 24, by means of which the nose 46 would pivot onto such a portion of the sliding guide 49 of the rotary member 22 on which the catch 24 can no longer arrest the rotary member 22 in its closing rotational position. If, in the locked state of the door latch 10, the user pushes against the door, this leads to an overlifting rotational movement of the rotary member 22 but, because the catch 24 is blocked against lateral pivoting by the second blocking arrangement 78, the nose 46 of the catch 24 comes into arresting engagement with the arresting edge 48 of the rotary member 22 again when the user removes the pressure against the door. In the unlocked state of the door latch 10, on the other hand, the second blocking arrangement 78 is out of range of the catch 24 and does not stand in the way of lateral pivoting thereof, as is required for a normal overlifting opening operation.

In addition, there is formed on the locking slider 16 a stop arrangement 80 which serves as a stop for a tongue 82 formed on the catch 24 in the case of emergency opening of the door latch 10. When the door is closed but still unlocked, the stop arrangement 80 is in an active position beneath the tongue 82 of the catch 24. If in this situation the door is pushed from inside the washing vessel of the washing machine (emergency opening), the carrier lever 14 is pivoted out of the rest position against the force of the spring elements 30. The rotary member 22 held on the carrier lever 14 moves with the carrier lever 14 as it pivots. Because the catch 24 is biased by the second biasing spring 50 in engagement with the outer periphery of the rotary member 22, the catch 24 also moves until the tongue 82 meets the stop arrangement 80. With continued pivoting of the carrier lever 14, the catch 24 is lifted out of arresting engagement with the rotary member 22 as a result of the tongue 82 striking the stop arrangement 80, so that the rotary member 22 is able to rotate out of the closing rotational position back into the release rotational position and the door latch 10 is opened. In the locking position of the locking slider 16, on the other hand, the stop arrangement 80 is out of range of the tongue 82, so that the emergency opening function of the door latch 10 is not available in the locked state.

Figure 7:
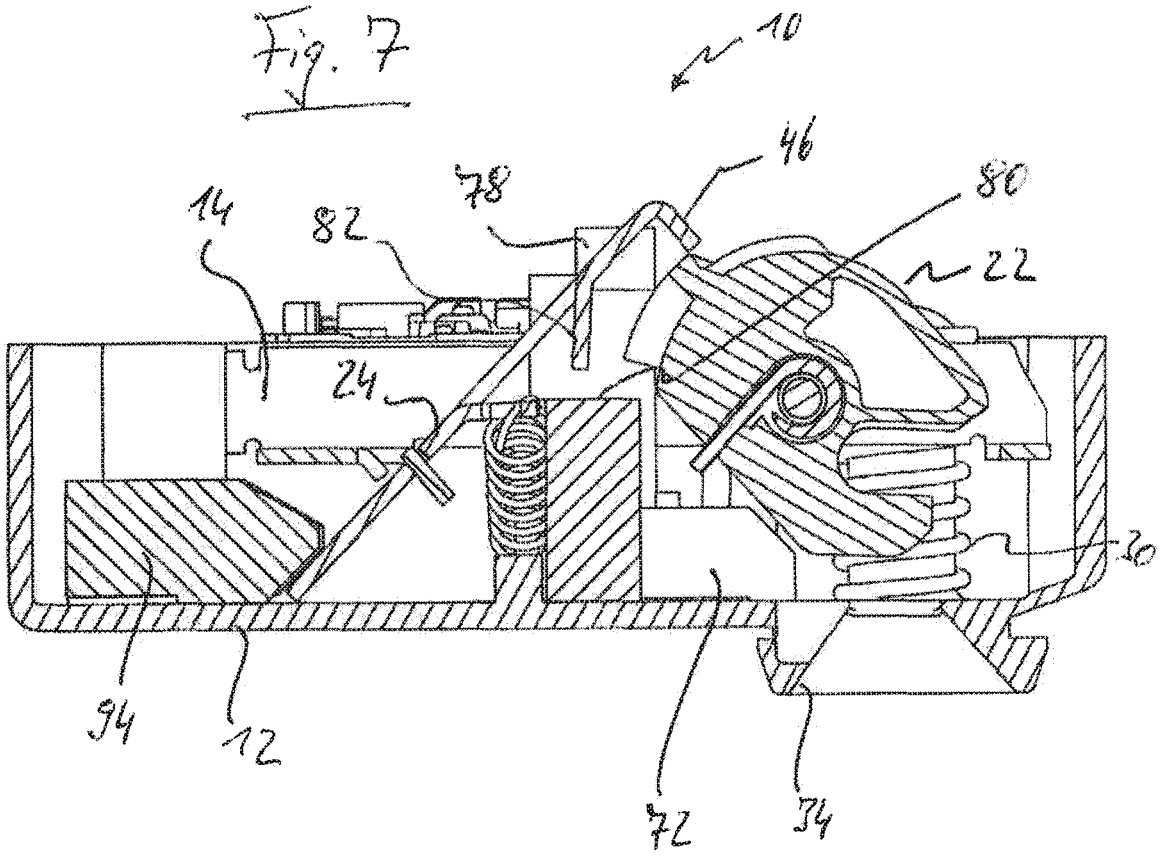
FIG. 7 is a sectional view of the door latch of FIG. 1 in a state upon opening of the latch by means of an opening assembly.

In addition to the possibility of opening the door latch 10 by overlifting (renewed pushing against the door from outside) and in addition to the possibility of emergency opening by pushing against the door from inside which is provided by the pivotability of the carrier lever 14, a third opening possibility is given in the case of the door latch 10 according to the embodiment shown, for the purpose of which the opening unit 20 is accommodated in the latch housing 12. The opening unit 20 permits controlled opening of the door latch 10 by means of an electrical control signal, which can be generated automatically by a control unit of the washing machine at the end or with a time delay after the end of a wash program. Alternatively or in addition, such a control signal can be generated by a user if he presses on a corresponding operating button of the washing machine. In the example shown, the opening unit 20 comprises a second electromagnetic actuator 86, separate from the electromagnetic actuator 60, having a magnetic coil 88 and an armature plunger 90 which cooperates with a control lever 94 pivotably mounted on the latch housing 12 about a pivot axis 92. The control lever 94 is biased into an out-of-engagement position by a fourth biasing spring 96. In FIGS. 1 to 6, the control lever 94 is shown in this out-of-engagement position. By feeding current to the magnetic coil 88, a movement of the armature plunger 90 into the magnetic coil 88 can be effected. The armature plunger 90 thereby initiates pivoting of the control lever 94 about the pivot axis 92 against the force of the fourth biasing spring 96 and urges the control lever 94 into an engagement position shown in FIG. 7. When the control lever 94 is pivoted out of the out-of-engagement position into the engagement position, the control lever 94 presses against an end of the catch 24 that is remote from the nose 46 and thereby lifts the catch 24 out of engagement with the outer periphery of the rotary member 22. The rotary member 22 is thus free to rotate out of the closing rotational position back into the release position. This situation is shown in FIG. 7 (for reasons of clarity, the closure member 32 is not shown in FIG. 7).

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A door latch for an electrical domestic appliance, the door latch comprising:

a rotary member which is arranged to be rotationally movable in a rotation plane between a closing rotational position and a release rotational position wherein the rotary member is spring-biased in the direction towards the release rotational position and is configured to hold, in the closing rotational position, a closure member in order to keep a door of the domestic appliance closed and to release, in the release rotational position, the closure member in order for the door to open;

a movably arranged catch for arresting engagement with the rotary member in its closing rotational position, wherein the rotary member is provided with a sliding guide for sliding engagement by the catch as the rotary member undergoes rotational movement, wherein the arresting engagement is defined by the catch engaging behind an arresting edge formed by the sliding guide, the arresting engagement preventing the rotary member from rotating back to the release rotational position, wherein the arresting engagement is releasable by rotating the rotary member beyond the closing rotational position thereby permitting the catch to spring away sideways from the arresting edge; and a locking slider, which is arranged to be movable between an unlocking position and a locking position, wherein the locking slider is configured to block, in its locking position, the rotary member against rotation out of the closing rotational position into the release rotational position when the door s closed and permit, in the unlocking position, such rotation of the rotary member, wherein the locking slider forms a first blocking arrangement configured to be clamped between the rotary member and an abutment structure when the locking slider is in the locking position and the rotary member is in a clamping rotational position lying between the closing rotational position and the release rotational position, wherein the clamping of the first blocking arrangement is releasable by a rotational movement of the rotary member out of the clamping rotational position in the direction towards the closing rotational position, wherein an actuator including a positioning element are arranged to be positionally adjustable by activation of the actuator, wherein the locking slider is arranged to be transferred against a restoring spring force from the unlocking position to the locking position by means of coupling with the positioning element, wherein the locking slider is arranged to return from the locking position to the unlocking position through action of the restoring spring force without coupling with the positioning element.

2. The door latch according to claim 1, wherein the rotation angle between the clamping rotational position and the closing rotational position of the rotary member is smaller than the rotation angle between the clamping rotational position and the release rotational position of the rotary member.

3. The door latch according to claim 1, wherein the rotation angle between the clamping rotational position and the closing rotational position of the rotary member is not more than 15 degrees.

4. The door latch according to claim 1, wherein the rotation angle between the clamping rotational position and the closing rotational position of the rotary member is not more than 10 degrees.

5. The door latch according to claim 1, wherein the rotation angle between the clamping rotational position and the closing rotational position of the rotary member is not more than 5 degrees.

6. The door latch according to claim 1, wherein the rotary member, in its clamping rotational position, is configured to hold the closure member in order to keep the door closed.

7. The door latch according to claim 1, wherein the locking actuator is an electromagnetic actuator.

8. The door latch according to claim 1, wherein the abutment structure is formed on a housing component of a housing of the door latch which accommodates the rotary member, the catch and the locking assembly.

9. The door latch according to claim 1, wherein the locking slider is arranged to be movable transversely to the rotation plane of the rotary member at least in an end portion of its movement path that includes the locking position.

10. The door latch according to claim 1, wherein the locking slider is arranged to be movable perpendicularly to the rotation plane of the rotary member at least in an end portion of its movement path that includes the locking position.

11. The door latch according to claim 1, wherein the locking slider is in the form of a locking slider which is arranged to be linearly movable in a sliding direction perpendicular to the rotation plane of the rotary member.

12. A door latch for an electrical domestic appliance, the door latch comprising:

a rotary member which is arranged to be rotationally movable in a rotation plane between a closing rotational position and a release rotational position wherein the rotary member is spring-biased in the direction towards the release rotational position and is configured to hold, in the closing rotational position, a closure member in order to keep a door of the domestic appliance closed and to release, in the release rotational position, the closure member in order for the door to open;

a movably arranged catch for arresting engagement with the rotary member in its closing rotational position, wherein the rotary member is provided with a sliding guide for sliding engagement by the catch as the rotary member undergoes rotational movement, wherein the arresting engagement is defined by the catch engaging behind an arresting edge formed by the sliding guide, the arresting engagement preventing the rotary member from rotating back to the release rotational position, wherein the arresting engagement is releasable by rotating the rotary member beyond the closing rotational position thereby permitting the catch to spring away sideways from the arresting edge; and a locking slider arranged to be movable between an unlocking position and a locking position, the locking slider configured to block, in its locking position, the rotary member against rotation out of the closing rotational position into the release rotational position when the door is closed and permit, in the unlocking position, such rotation of the rotary member, wherein the locking slider forms a first blocking arrangement configured to be clamped between the rotary member and an abutment structure when the locking slider is in the locking position and the rotary member is in a clamping rotational position lying between the closing rotational position and the release rotational position, wherein the locking member forms a second blocking arrangement configured to block the catch in at least one movement direction in the locking position of the locking member.

13. A door latch for an electrical domestic appliance, the door latch comprising:

a rotary member which is arranged to be rotationally movable in a rotation plane between a closing rotational position and a release rotational position wherein the rotary member is spring-biased in the direction towards the release rotational position and is configured to hold, in the closing rotational position, a closure member in order to keep a door of the domestic appliance closed and to release, in the release rotational position, the closure member in order for the door to open;

a movably arranged catch for arresting engagement with the rotary member in its closing rotational position, wherein the rotary member is provided with a sliding guide for sliding engagement by the catch as the rotary member undergoes rotational movement, wherein the arresting engagement is defined by the catch engaging behind an arresting edge formed by the sliding guide, the arresting engagement preventing the rotary member from rotating back to the release rotational position, wherein the arresting engagement is releasable by rotating the rotary member beyond the closing rotational position thereby permitting the catch to spring away sideways from the arresting edge;

a locking slider arranged to be movable between an unlocking position and a locking position, the locking slider configured to block a movable component of the door latch when the door is closed; and a carrier lever for the rotary member which is arranged to be displaceable against spring force out of a rest position into an emergency opening position, wherein the catch is arranged to be lifted out of arresting engagement with the rotary member by striking a stop element upon displacement of the carrier lever out of the rest position into the emergency opening position, wherein the stop element is formed on the locking slider and is moved in the locking position of the locking slider out of a standby position, in which the stop element is ready for striking by the catch.

14. The door latch according to claim 13 wherein the carrier lever is arranged to be displaceable pivotally.

15. The door latch according to claim 1, comprising an opening assembly having an actuator and an actuating element, movable by activation of the opening actuator, for acting on the catch in order to lift it out of arresting engagement with the rotary member.

16. The door latch according to claim 15, wherein the actuator is an electromagnetic actuator.

* * * * *